US010923798B2

(12) United States Patent
Li et al.

(10) Patent No.: US 10,923,798 B2
(45) Date of Patent: Feb. 16, 2021

(54) ANTENNA SUPPORT AND ANTENNA POSITION CONTROL SYSTEM

(71) Applicant: GUANGZHOU CHANGEN ELECTRONIC TECHNOLOGY CO., LTD, Guangdong (CN)

(72) Inventors: Nan Li, Guangdong (CN); Jun Li, Guangdong (CN)

(73) Assignee: GUANGZHOU CHANGEN ELECTRONIC TECHNOLOGY CO., LTD, Guangdong (CN)

( * ) Notice: Subject to any disclaimer, the term of this patent is extended or adjusted under 35 U.S.C. 154(b) by 311 days.

(21) Appl. No.: 16/067,900

(22) PCT Filed: Dec. 30, 2016

(86) PCT No.: PCT/CN2016/113875

§ 371 (c)(1),
(2) Date: Jul. 3, 2018

(87) PCT Pub. No.: WO2017/118357

PCT Pub. Date: Jul. 13, 2017

(65) Prior Publication Data

US 2020/0266518 A1 Aug. 20, 2020

(30) Foreign Application Priority Data

Jan. 4, 2016 (CN) ..... 201610009790.9

(51) Int. Cl.
*H01Q 1/22* (2006.01)
*H01Q 3/08* (2006.01)

(52) U.S. Cl.
CPC ..... *H01Q 1/22* (2013.01); *H01Q 3/08* (2013.01)

(58) Field of Classification Search
CPC ..... H01Q 3/08; H01Q 3/32; H01Q 1/125; H01Q 1/22
USPC ..... 343/766
See application file for complete search history.

(56) References Cited

U.S. PATENT DOCUMENTS 4,410,852 A * 10/1983 Guretzky ..... G01R 27/2605 318/662
2012/0169558 A1* 7/2012 Huang ..... G01R 31/002 343/766

FOREIGN PATENT DOCUMENTS

| | | | |
|---|---|---|---|
| CN | 200959062 | Y | 10/2007 |
| CN | 201000531 | Y | 1/2008 |
| CN | 102569981 | A | 7/2012 |
| CN | 203289574 | U | 11/2013 |
| CN | 103579734 | | 2/2014 |
| CN | 103945172 | A | 7/2014 |

(Continued)

OTHER PUBLICATIONS

State Intellectual Property Office of the P.R. China; Mar. 14, 2017.

*Primary Examiner* — Ricardo I Magallanes
(74) *Attorney, Agent, or Firm* — PatShegen IP LLC; Moshe Pinchas

(57) ABSTRACT

Provided are an antenna mount and a system for controlling antenna position. The antenna mount provided by the present disclosure includes: an antenna mount body, a connecting arm connected to the antenna mount body, an adapting piece fixedly connected to the connecting arm, an antenna arranged on the adapting piece, and a non-metallic cylinder arranged on the adapting piece, wherein the non-metallic cylinder can drive the antenna to rotate in a range of 0-90°.

14 Claims, 6 Drawing Sheets

(56) References Cited

FOREIGN PATENT DOCUMENTS

| | | | |
|---|---|---|---|
| CN | 204362006 | U | 5/2015 |
| CN | 105428783 | | 3/2016 |
| CN | 105467255 | A | 4/2016 |
| CN | 105681634 | A | 6/2016 |
| CN | 205336401 | U | 6/2016 |
| CN | 205452523 | | 8/2016 |
| CN | 205749703 | U | 11/2016 |

* cited by examiner

ANTENNA SUPPORT AND ANTENNA POSITION CONTROL SYSTEM

CROSS-REFERENCE TO RELATED APPLICATIONS

This application claims the benefit of priority to Chinese Patent Application No. 201610009790.9, filed on Jan. 4, 2016, and entitled "ANTENNA MOUNT AND SYSTEM FOR CONTROLLING ANTENNA POSITION", which disclosures are herein incorporated by reference.

TECHNICAL FIELD

The present disclosure relates to corollary equipment for electromagnetic compatibility testing and particularly to an antenna mount and a system for controlling antenna position.

BACKGROUND

With the rapid development of society and economy, people pay more and more attention on electromagnetic compatibility of products; for products that are included in the national compulsory product certification scope, electromagnetic compatibility testing has become a must-test item.

When conducting electromagnetic compatibility testing by using a wide test site or an anechoic chamber, an antenna needs to be lift or rotated to change an angle of the antenna in order to keep a test distance between a test object and the antenna to be a definite value. However, the volume of different test objects varies, which makes the distance between test objects and the antenna to be different as well. If using an existing antenna mount, the antenna mount needs to be moved to make the distance between the test object and the antenna to be the definite value, which is inconvenient and an accuracy of the test will be affected because of possibly improper positioning of the antenna mount, which is positioned manually by an operator every time.

Moreover, frequently-used antenna mounts are motor-driven at present, a motor will generate large electromagnetic disturbance outwards in the test, which will disturb the receive and dispatch of test signal of the antenna, so as to affect the result of electromagnetic compatibility testing of the products.

SUMMARY

To address the deficiency of the existing technology, the present disclosure provides an antenna mount and a system for controlling antenna position.

A first aspect of the present disclosure provides an antenna mount, the antenna mount comprises: an antenna mount body, a connecting arm connected to the antenna mount body, an adapting piece fixedly connected to the connecting arm, an antenna arranged on the adapting piece, and a non-metallic cylinder arranged on the adapting piece, wherein the non-metallic cylinder can drive the antenna to rotate in a range of 0-90°.

According to an implementation of the present disclosure, the adapting piece comprises a first adapting piece fixedly connected to the connecting arm and a second adapting piece connected to the first adapting piece, the antenna and the non-metallic cylinder are mounted on the second adapting piece; wherein the following structure can realize that, the non-metallic cylinder can drive the antenna to rotate in a range of 0-90°:

the second adapting piece comprises: a hollow cavity, an empty slot arranged inside the cavity, a third mounting hole arranged inside the cavity and penetrating upper and lower surfaces of the adapting piece, and a fourth mounting hole communicated with the empty slot;

the non-metallic cylinder comprises a first cylinder body, an end cover, a first piston rod, and a first piston placed in the first cylinder body; a first end of the first piston rod is fixedly connected with the first piston, a second end of the first piston rod passes through a through hole formed on the end cover and exposing outside the first cylinder body; the first piston rod of the non-metallic cylinder is placed in the empty slot of the second adapting piece after passing through the end cover then passing through the fourth mounting hole of the second adapting piece; the antenna is mounted in the third mounting hole with a rotary sleeve arranged outside, and the first piston rod is connected with the rotary sleeve; wherein the first piston rod can drive the rotary sleeve to rotate in the range of 0-90° when telescopically moving back and forth along the empty slot, and then drives the antenna to rotate in the range of 0-90°.

According to an implementation of the present disclosure, the adapting piece comprises a first adapting piece fixedly connected to the connecting arm and a second adapting piece connected to the first adapting piece, the antenna and the non-metallic cylinder are mounted on the second adapting piece; wherein the antenna can move up and down relative to the second adapting piece.

Furthermore, the following structure can realize that, the antenna can move relative to the second adapting piece:

the second adapting piece comprises a hollow cavity and a third mounting hole arranged inside the cavity and penetrating upper and lower surfaces of the second adapting piece; the antenna is mounted in the third mounting hole with a rotary sleeve arranged outside, at least one end of the antenna extends out of the third mounting hole; wherein, the rotary sleeve comprises an inner sleeve fixedly connected with the antenna, and an outer sleeve arranged outside of the inner sleeve; an axial sliding slot is arranged on a surface of the inner sleeve near the outer sleeve, a surface of the outer sleeve near the inner sleeve is provided with a slider which is matched with the sliding slot and can move along the sliding slot.

Furthermore, the slider can move vertically along the sliding slot, optionally, a range of the movement can be defined according to the size of specific products, for instance, the range of the movement being 21 mm.

According to an implementation of the present disclosure, the adapting piece comprises a first adapting piece fixedly connected to the connecting arm and a second adapting piece connected to the first adapting piece, the antenna and the non-metallic cylinder are mounted on the second adapting piece; the antenna mount further comprises a first non-metallic position sensor arranged on the second adapting piece, wherein the antenna can move up and down relative to the second adapting piece, and the first non-metallic position sensor sends a first air pressure signal to the outside when the antenna is raised to a first position relative to the second adapting piece.

Furthermore, the following structure can realize that, the first non-metallic position sensor sends a first air pressure signal to the outside when the antenna is raised to a first position relative to the second adapting piece:

the first non-metallic position sensor comprises: a second cylinder body, a second piston placed in the second cylinder body, and a second piston rod whose one end is fixedly connected with the second piston; the second cylinder body comprises a second cylinder body upper chamber and a second cylinder body lower chamber; a side wall of the second cylinder body lower chamber is provided with a first radial air hole, a second radial air hole arranged on the lower end of the first radial air hole, and a third radial air hole arranged axially symmetrically with the first radial air hole;

a portion of the second piston rod combined with the inner wall of the second cylinder body lower chamber is provided with a first seal ring and a second seal ring in sequence from top to bottom, and the second piston rod is provided with a breather pipe (for example, the breather pipe is I-shaped) internally; an axial distance between the first seal ring and the second seal ring is equal to an axial distance between the first radial air hole and the second radial air hole; the first seal ring, the second seal ring, and the inner chamber of the second cylinder body lower chamber are sealed and in clearance fit; and the first seal ring is provided with a first radial through-hole, the second seal ring is provided with a second radial through-hole;

the second adapting piece further comprises a fifth mounting hole arranged on the outer periphery of the cavity of the second adapting piece and penetrating the upper and lower surfaces of the second adapting piece; the second cylinder body of the first non-metallic position sensor is arranged in the fifth mounting hole of the second adapting piece, and another end of the second piston rod of the first non-metallic position sensor extends out of the fifth mounting hole;

the antenna is configured to detect that an end of a test object and the end of the second piston rod which is in the first non-metallic position sensor and extends out of the fifth mounting hole are connected through a junction plate (optionally, an axial direction of the antenna is the same as an axial direction of the piston rod in the first non-metallic position sensor), and an axial distance between the end of the second piston rod extending out of the fifth mounting hole and the test object is equal to an axial distance between an end of the antenna and the test object;

the antenna drives the second piston rod in the first non-metallic position sensor to rise relative to the second cylinder body when the antenna rises relative to the second adapting piece; the first radial air hole is communicated with the third radial air hole when the antenna rises to a first position relative to the second adapting piece; the first non-metallic position sensor sends the first air pressure signal to the outside when the first radial air hole is communicated with the third radial air hole.

According to an implementation of the present disclosure, a pipe mouth of the breather pipe, the first radial through hole, and the first radial air hole are communicated with each other, and another pipe mouth of the breather pipe, the second radial through hole, and the second radial air hole are communicated with each other, when the second piston rod of the first non-metallic position sensor moves to a second position (namely, the antenna declines to the second position relative to the second adapting piece).

According to an implementation of the present disclosure, the antenna mount body further comprises an X-axis displacement adjustment mechanism, and the X-axis displacement adjustment mechanism is configured to drive the connecting arm to move along the X axis.

According to an implementation of the present disclosure, the antenna mount body further comprises an Y-axis displacement adjustment mechanism, and the Y-axis displacement adjustment mechanism is configured to drive the connecting arm to move along the Y axis.

According to an implementation of the present disclosure, the antenna mount body further comprises an Z-axis displacement adjustment mechanism, and the Z-axis displacement adjustment mechanism is configured to drive the connecting arm to move along the Z axis.

According to an implementation of the present disclosure, the X-axis displacement adjustment mechanism, the Y-axis displacement adjustment mechanism, and the Z-axis displacement adjustment mechanism are provided with an X-axis position sensor, a Y-axis position sensor, and a Z-axis position sensor respectively. The X-axis position sensor, the Y-axis position sensor, and the Z-axis position sensor are configured to transmit an X-axis coordinate of an X-axis slider, a Y-axis coordinate of a Y-axis slider, and a Z-axis coordinate of a Z-axis slider respectively.

According to an implementation of the present disclosure, the adapting piece comprises a first adapting piece fixedly connected to the connecting arm and a second adapting piece connected to the first adapting piece; a side wall of the first adapting piece is provided with a first mounting hole, an end of a step-type connecting shaft is fixedly connected with the second adapting piece, another end of the step-type connecting shaft is arranged in the first mounting hole of the first adapting piece, wherein the second adapting piece can drive the step-type connecting shaft to rotate around the axis of the step-type connecting shaft.

Furthermore, the first adapting piece further comprises a first positioning hole, the second adapting piece further comprises a horizontal positioning hole and a vertical positioning hole, and the first positioning hole of the first adapting piece is detachably connected with the horizontal positioning hole or the vertical positioning hole of the second adapting piece through a bolt; wherein the second adapting piece can drive the step-type connecting shaft to make 0° or 90° rotation around the axis of the step-type connecting shaft when a connecting type of the first adapting piece and the second adapting piece is switched between the horizontal positioning hole and the vertical positioning hole.

Furthermore, the antenna mount further comprises a second non-metallic position sensor with a connecting rod which can telescopically move, the connecting rod of the second non-metallic position sensor is connected with the step-type connecting shaft through a transmission adapting piece; and the step-type connecting shaft drives the connecting rod to move telescopically by the transmission adapting piece when the step-type connecting shaft makes 0° or 90° rotation around the axis.

A second aspect of the present disclosure provides a system for controlling antenna position, the system comprises an antenna mount provided by the first aspect of the present disclosure, the system further comprises a first gas-electric conversion device connected with the first non-metallic position sensor of the antenna mount, a first position control device connected with the first gas-electric conversion device; the first non-metallic position sensor of the antenna mount is configured to send a first air pressure signal to the first gas-electric conversion device, the first gas-electric conversion device is configured to convert the received first air pressure signal to a first electric signal and send the first electric signal to the first position control device; and the first position control device is configured to determine that the first non-metallic position sensor and/or the antenna effectively touches a test object when receiving a first electric signal sent by the first gas-electric conversion device.

According to an implementation of the present disclosure, the system for controlling antenna position further comprises a first gas delivery device connected with the first position control device, and an end of the second cylinder body upper chamber is provided with an axial air hole; wherein the first gas delivery device is configured to supply gas to a cylinder body upper chamber of the first non-metallic position sensor.

According to an implementation of the present disclosure, the first non-metallic position sensor is configured to send a second air pressure signal to the first gas-electric conversion device, and the first gas-electric conversion device is configured to: convert the received second air pressure signal to a second electric signal and send the second electric signal to the first position control device; and the first position control device is configured to: determine that the first non-metallic position sensor completes reset, and determine that the antenna can enter a test state, when receiving the second electric signal sent by the first gas-electric conversion device.

A third aspect of the present disclosure provides a system for controlling antenna position, the system comprises an antenna mount provided by the first aspect of the present disclosure, the system further comprises a second non-metallic position sensor, a second gas-electric conversion device connected with the second non-metallic position sensor, and a second position control device connected with the second gas-electric conversion device; the second non-metallic position sensor is configured to send a third air pressure signal or a fourth air pressure signal to the second gas-electric conversion device; the second gas-electric conversion device is configured to convert the received third air pressure signal or the fourth air pressure signal to a third electric signal or a fourth electric signal and send the third electric signal or the fourth electric signal to the second position control device; the second position control device is configured to determine that the antenna is placed vertically or horizontally when receiving the third electric signal or the fourth electric signal.

Advantageous effects are provided by technical solutions of the present disclosure, that is: the antenna mount and the system for controlling antenna position provided by the present disclosure not only have convenient operation and accurate positioning, but also can adjust the position of the antenna mount in the X, Y, and Z axis directions in some implementations. In some implementations, a horizontal pitch angle and a rotation angle of the antenna can also be controlled, so as to enable the positioning of the antenna in a multidimensional space, thereby increasing the applicability of the antenna mount and the system for controlling antenna position. More importantly, these functions can be achieved through a non-metallic transmission control structure, which is not only intelligent and highly automated, but also reduces the electromagnetic interference introduced by the antenna mount to the test environment as much as possible.

DETAILED DESCRIPTION OF ILLUSTRATED EMBODIMENTS

Figure 1:
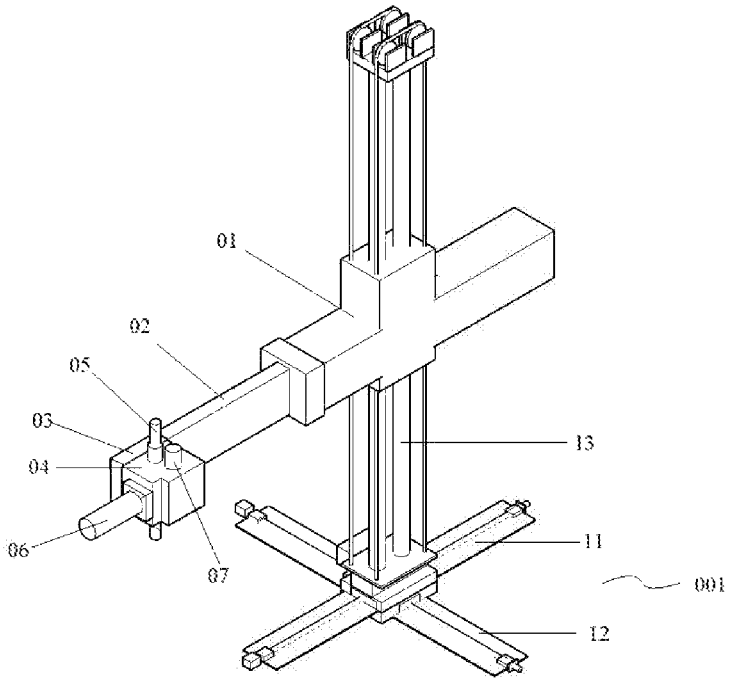
FIG. 1 is a schematic structure diagram illustrating an antenna mount 001 according to an embodiment of the present disclosure.

The following further describes the present disclosure with reference to the accompanying drawings and specific embodiments, the illustrative embodiments and descriptions therein are only used to explain the present disclosure, but are not intended to limit the present disclosure.

What should be noted is, in the disclosure, the technical words "first", "second" are only be used for a descriptive purpose, and are not to be understood to indicate or imply the relative importance or imply the number of the indicated technical features. Therefore, features defined with "first", "second" may include one or more of the features explicitly or implicitly. In the description of the disclosure, "multiple" means two or more than two, unless specifically defined otherwise.

In the disclosure, the technical words "the first position", "the second position" should be understood in generalization. For example, it could be a location point, or an activity area.

In the disclosure, the technical words "move down", "move up", "rise" or "decline" et al. should be understood in generalization. For example, the first feature "moves down", "moves up", "rises" or "declines" relative to the second feature could represents the first feature moves in the direction of the first position of the second feature relative to the second feature, or the first feature moves in the direction of the second position of the second feature relative to the second feature.

In the disclosure, the technical words "load", "install", "be linked to", "connect to", "fix" et al. should be understood in generalization, unless specifically defined otherwise. For example, these technical words are described as fixed joint or removable connection or the integration of the connection; or mechanical joint or electrical connection; or direct connection or indirect connection via the middle medium or internal connection between the two components. The skilled persons in the art can understand the specific meaning about these technical words in the disclosure according to the specific circumstance.

In the disclosure, unless specifically defined otherwise, the first feature being located on the second feature or under the second feature could disclose the direct connection between the first feature and the second feature, and could also disclose that the first feature is not directly connected to the second feature but adopts other ways to connect to the second feature. Furthermore, the first feature being located "above" and "on" the second feature means that the first feature is located right above the second feature or above the second feature, or only means that the horizontal height of the first feature is higher than that of the second feature. Also the first feature being located "under" and "below" the second feature means that the first feature is located right under the second feature or under the second feature, or only means that the horizontal height of the first feature is lower than that of the second feature.

Embodiment One an Antenna Mount

Figure 2:
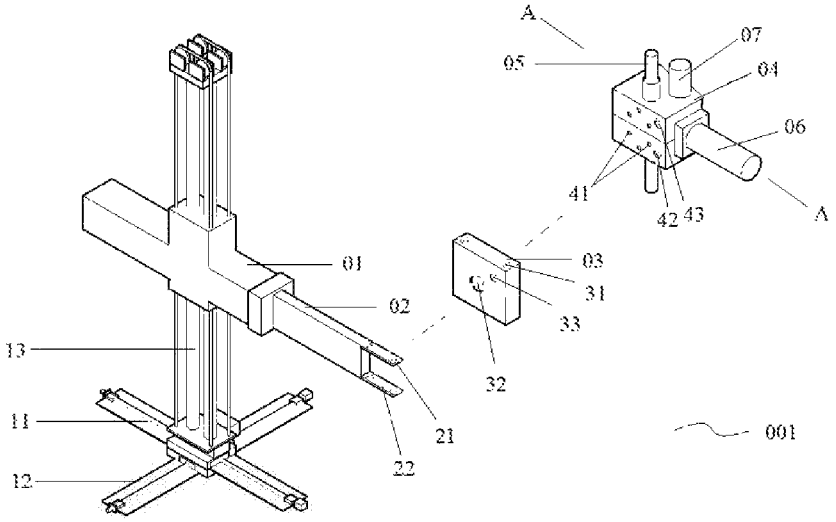
FIG. 2 is a schematic structural decomposition diagram illustrating the antenna mount 001 according to an embodiment of the present disclosure.
Figure 3:
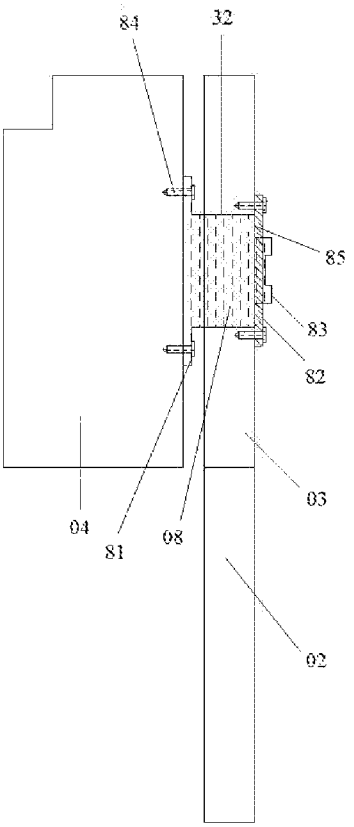
FIG. 3 is a schematic connection diagram of a first adapting piece 03 and a second adapting piece 04 according to an embodiment of the present disclosure.

FIG. 1 is a schematic structure diagram illustrating an antenna mount 001 according to an embodiment of the present disclosure; FIG. 2 is a schematic structural decomposition diagram illustrating the antenna mount 001 according to an embodiment of the present disclosure; FIG. 3 is a schematic connection diagram of a first adapting piece 03 and a second adapting piece 04 according to an embodiment of the present disclosure.

As shown in FIG. 1-3, the antenna mount 001 provided by the present disclosure comprises an antenna mount body 01, a connecting arm 02 connected to the antenna mount body 01, a first adapting piece 03 fixedly connected to the connecting arm 02, a second adapting piece 04 connected to the first adapting piece 03, an antenna 05 arranged on the second adapting piece 04, a non-metallic cylinder 06 arranged on the second adapting piece 04, and a first non-metallic position sensor 07 arranged on the second adapting piece 04.

According to a first implementation of the present disclosure, the non-metallic cylinder 06 can drive the antenna 05 to rotate in a range of 0-90° around the axis of the antenna.

According to a second implementation of the present disclosure, the antenna 05 can move up and down relative to the second adapting piece 04.

According to a third implementation of the present disclosure, the antenna 05 can move up and down relative to the second adapting piece 04, and the first non-metallic position sensor 07 sends a first air pressure signal to the outside when the antenna 05 is raised to a first position relative to the second adapting piece 04.

According to a fourth implementation of the present disclosure, the antenna mount body 01 further comprises an X-axis displacement adjustment mechanism 11, and the X-axis displacement adjustment mechanism 11 is configured to drive the connecting arm 02 to move along the X axis.

According to a fifth implementation of the present disclosure, the antenna mount body 01 further comprises an Y-axis displacement adjustment mechanism 12, and the Y-axis displacement adjustment mechanism 12 is configured to drive the connecting arm 02 to move along the Y axis.

According to a sixth implementation of the present disclosure, the antenna mount body 01 further comprises an Z-axis displacement adjustment mechanism 13, and the Z-axis displacement adjustment mechanism 13 is configured to drive the connecting arm 02 to move along the Z axis.

It can be understood that, directions of the X axis and Y axis of the present disclosure can be horizontal directions, and the Z axis can be a vertical direction.

It can be understood that, the X-axis displacement adjustment mechanism 11, the Y-axis displacement adjustment mechanism 12, and the Z-axis displacement adjustment mechanism 13 provided by the present disclosure can use the conventional design in the industry, such as, the X-axis displacement adjustment mechanism can includes an X-axis sliding rail, an X-axis screw rod arranged on the X-axis sliding rail, and an X-axis slider matched with the X-axis screw rod; the X-axis slider is fixedly connected with a base, and an X-axis motor is provided at one end of the X-axis sliding rail. In the present implementation, when the X-axis motor works, the X-axis screw rod is driven to rotate, so that the X-axis slider and the base move along the X-axis direction, and the antenna can move along the X-axis direction.

For instance, the Z-axis displacement adjusting mechanism can include a column arranged on the base, an elevating seat that is sleeved on the column and can move up and down along the column, and the elevating seat is connected with the connecting arm 02; a top surface of the column is provided with a driven wheel, the base is provided with a driving wheel and a lifting motor connected with the driving wheel, a driving chain is surrounded between the driven wheel and the driving wheel, and the lifting motor can drive the slider to move up and down along, so as to realize the movement of the antenna in the Z-axis direction.

According to a seventh implementation of the present disclosure, the X-axis displacement adjustment mechanism 11, the Y-axis displacement adjustment mechanism 12, and the Z-axis displacement adjustment mechanism 13 are provided with an X-axis position sensor, a Y-axis position sensor, and a Z-axis position sensor respectively. The X-axis position sensor, the Y-axis position sensor, and the Z-axis position sensor are configured to transmit an X-axis coordinate of an X-axis slider, a Y-axis coordinate of a Y-axis slider, and a Z-axis coordinate of a Z-axis slider to an external control system respectively.

According to an eighth implementation of the present disclosure, the connecting arm 02 is connected to the antenna mount body 01, the first adapting piece 03 is fixedly connected to the connecting arm 02.

In this specific implementation, an end of the connecting arm 02 is fixedly connected to the antenna mount body 01, another end of the connecting arm 02 is provided with a "C" shaped groove, upper and lower ends of the groove are provided with mounting holes; both the upper end and the lower end of the first adapting piece 03 are provided with a plurality of mounting holes 31 matching with the upper and lower mounting holes of the connecting arm 02; the first adapting piece 03 is installed in the "C" shaped groove of the connecting arm 02, and mounting holes of an upper arm 21 and a lower arm 22 of the connecting arm 02 are detachably connected with the mounting hole 31 of the first adapting piece 03 through a bolt or a screw.

In this specific implementation, a specific structure that one end of the connecting arm 02 is fixedly connected on the antenna mount body 01 is: the antenna mount body 01 includes an column and an elevating seat that is sleeved on the column and can move up and down along the column; and one end of the connecting arm 02 is fixedly connected on the elevating seat on the column of the antenna mount body 01, and the connecting arm 02 can move up and down with the elevating seat.

According to a ninth implementation of the present disclosure, as shown in FIG. 3, the first adapting piece 03 is connected with the second adapting piece 04 through a step-type connecting shaft 08.

In this specific implementation, a side wall of the first adapting piece 03 is provided with a first mounting hole 32 and a first positioning hole 33 (both the first mounting hole 32 and the first positioning hole 33 are through holes, that is, the first mounting hole 32 and the first positioning hole 33 passing through the both side sidewalls of the first adapting piece 03); a side wall of the second adapting piece 04 is provided with a second mounting hole 41, a horizontal positioning hole 42, and a vertical positioning hole 43; wherein one end of the step-type connecting shaft 08 is fixed on the side wall which has the second mounting hole 41 of second adapting piece 04, another end of the step-type connecting shaft 08 passes through the first mounting hole 32 of the first adapting piece 03, and the step-type connecting shaft 08 is rotatable in the first mounting hole 32; the first positioning hole 33 of the first adapting piece 03 and the horizontal positioning hole 42 or the vertical positioning hole 43 of the second adapting piece 04 are detachably connected by a bolt or a screw.

In this specific implementation, the step-type connecting shaft 08 includes: a first step 81, a second step 82 connected with the first step 81 and passing through the mounting hole 31, and a third step 83 connected with the second step 82, wherein the first step 81 is connected with a side wall with the second mounting hole 41 of the second adapting piece 04 by a screw 84; the second step 82 penetrates the first mounting hole 32, the third step 83 passes through the first mounting hole 32, and the step-type connecting shaft 08 can rotationally move in the first mounting hole 32.

In this specific implementation, the step-type connecting shaft 08 further includes a dead plate 85, the dead plate 85 is sleeved on the third step, the dead plate 85 is connected with the connecting arm 02 through a screw, which makes the antenna mount more firm.

In this specific implementation, when a technician connects the first positioning hole 33 with the horizontal positioning hole 42 or the vertical positioning hole 43 through a bolt or a screw, the second adapting piece 04 is rotated 0 or 90°, so as to make the antenna 05 sleeved on the second adapting piece 04 to rotate along with the second adapting piece 04 by 0 or 90°, that is, making the antenna 05 to have different position states of being placed vertically or horizontally.

Figure 4:
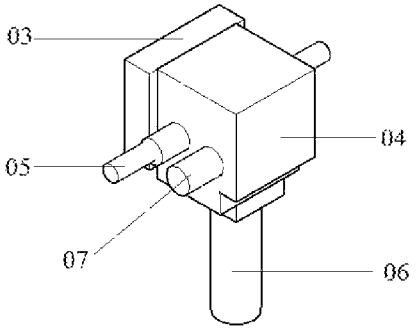
FIG. 4 is a schematic diagram illustrating the second adapting piece 04 when an antenna is placed horizontally according to an embodiment of the present disclosure.

It can be understood that, because the first adapting piece 03 is fixed on the connecting arm 02, the first adapting piece 03 and the second adapting piece 04 are movably connected through the step-type connecting shaft 08, the technician only need to connect the first positioning hole 33 of the first adapting piece 03 with the horizontal positioning hole 42 or the vertical positioning hole 43 of the second adapting piece 04 to realize the change of different orientations of the second adapting piece 04, that is, changing the state of the plug or the screw inserted in the horizontal positioning hole 42 or the vertical positioning hole 43 to change the position state of the first adapting piece 02, and then, driving the step-type connecting shaft 08 to rotate around the axis of the step-type connecting shaft 08 through the second adapting piece 04. As shown in FIG. 4, in this state, the antenna 05 on the second adapting piece 04 is placed horizontally; if changing the inserting position of the bolt or the screw, the antenna on the second adapting piece 04 can be placed vertically (that is, the location of the non-metallic cylinder 06 in FIG. 4).

Figure 5:
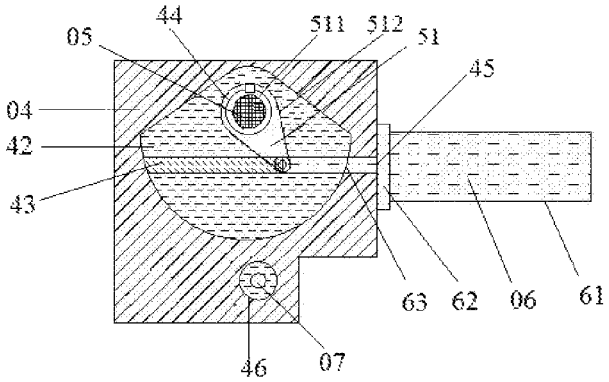
FIG. 5 is an A-A sectional view illustrating the second adapting piece 04 of FIG. 2 according to an embodiment of the present disclosure.
Figure 6:
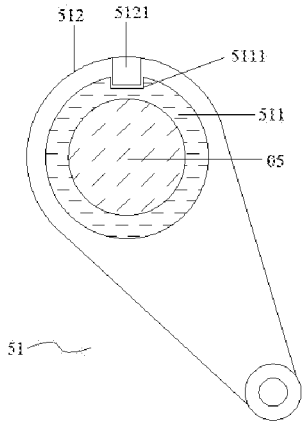
FIG. 6 is a schematic connection diagram of a rotary sleeve 51 and the antenna 05 according to an embodiment of the present disclosure.

FIG. 5 is an A-A sectional view illustrating the second adapting piece 04 of FIG. 2 according to an embodiment of the present disclosure; FIG. 6 is a schematic connection diagram of a rotary sleeve 51 and the antenna 05 according to an embodiment of the present disclosure.

According to a tenth implementation of the present disclosure, the following structure can realize that, the antenna 05 can move up and down relative to the second adapting piece 04 in the first implementation of the present disclosure:

as shown in FIG. 5 and FIG. 6, the second adapting piece 04 further includes a hollow cavity 42 and a third mounting hole 44 arranged inside the cavity 42 and penetrating upper and lower surfaces of the second adapting piece 04;

the antenna 05 is mounted in the third mounting hole 44 with a rotary sleeve 51 arranged outside, at least one end of the antenna 05 extends out of the third mounting hole 44; wherein, the rotary sleeve 51 includes an inner sleeve 511 fixedly connected with the antenna 05, and an outer sleeve 512 arranged outside of the inner sleeve 511; an axial sliding slot 5111 is arranged on a surface of the inner sleeve 511 near the outer sleeve 512, a surface of the outer sleeve 512 near the inner sleeve 511 is provided with a slider 5121 which is matched with the sliding slot 5111 and arranged in the sliding slot 5111.

In this specific implementation, the slider 5121 can move vertically along the sliding slot 5111, optionally, a range of the movement can be defined according to the size of specific products, for instance, the range of the movement being 21 mm.

In this specific implementation, the length of the sliding slot 5111 is less than or equal to the height of the cavity 42. In this way, when the antenna 05 touches the test object, the antenna 05 and the inner sleeve 511 fixedly connected to the antenna stop moving, and the slider 5121 can slide along the axial sliding slot 5111, so as to make the second adapting piece 04 and the outer sleeve 512 of the rotary sleeve 51 continue to move a distance to the test object, that is, the antenna 05 can move up and down relative to the second adapting piece 04, optionally, a range of the movement can be defined according to the size of specific products, for instance, the range of the movement being 21 mm.

According to a eleventh implementation of the present disclosure, the following structure can realize that, the non-metallic cylinder 06 can drive the antenna 05 to rotate around the axis of the antenna in a range of 0-90° in a second implementation of the present disclosure:

as shown in FIG. 5 and FIG. 6, the second adapting piece 04 further includes: a hollow cavity 42, an empty slot 43 arranged inside the cavity 42, a third mounting hole 44 arranged inside the cavity 42 and penetrating upper and lower surfaces of the second adapting piece 04, and a fourth mounting hole 45 communicated with the empty slot 43;

the non-metallic cylinder 06 includes a first cylinder body 61, an end cover 62, a first piston rod 63, and a first piston 64 placed in the first cylinder body 61; a first end of the first piston rod 63 is fixedly connected with the first piston 64, a second end of the first piston rod 63 passes through a third through hole (which is not shown in FIG. 5) formed on the end cover 62 and exposes outside the first cylinder body 61;

the first piston rod 63 of the non-metallic cylinder 06 is placed in the empty slot 43 of the second adapting piece 04 after passing through the end cover 62 then passing through the second mounting hole 45 of the second adapting piece 04; the antenna 05 is mounted in the third mounting hole 44 with a rotary sleeve 51 arranged outside, and the first piston rod 63 is connected with the rotary sleeve 51; wherein the first piston rod 63 can drive the rotary sleeve 51 to rotate in the range of 0-90° when telescopically moving back and forth along the empty slot 43, and then drives the antenna 05 to rotate in the range of 0-90°.

Figure 7:
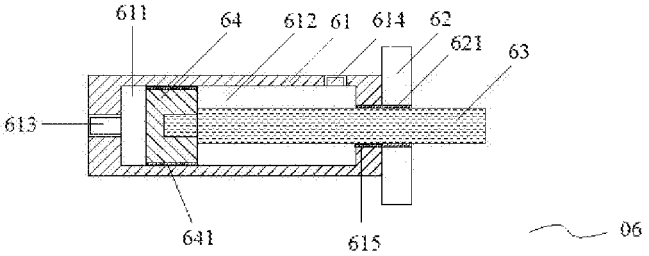
FIG. 7 is a sectional view illustrating a non-metallic cylinder 06 according to an embodiment of the present disclosure.

In this specific implementation, the first piston rod 63 of the non-metallic cylinder 06 provided by the present disclosure is pneumatic controlled when telescopically moving back and forth along the empty slot 43, and the specific structure of the non-metallic cylinder 06 provided by the present disclosure is shown in FIG. 7, which includes: a first cylinder body 61, an end cover 62, a first piston rod 63, and a first piston 64 placed in the first cylinder body 61; a first end of the first piston rod 63 is fixedly connected with the first piston 64, a second end of the first piston rod 63 passes through a third through hole (which is not shown in FIG. 5) formed on the end cover 62 and exposes outside the first cylinder body 61; wherein, the piston 64 divides the first cylinder 61 into a first chamber 611 and a second chamber 612, a first through hole 613 provided on the wall of the first cylinder 61 and communicating with the first chamber 611, and a second through hole 614 provided on the wall of the first cylinder 61 and communicating with the second chamber 612.

In this specific implementation, the first through hole 613 and the second through hole 614 are respectively connected to an air pressure control device through a pipeline. The air pressure control device controls the air flow direction of the first through hole 613 and the second through hole 614 by controlling the air inlet and outlet valves, thereby driving the first piston rod 63 telescopically moves back and forth along the empty slot 43.

When the first through hole 613 is an air inlet hole, the second through hole 614 is an air outlet hole; conversely, when the first through hole 613 is an air outlet hole, the second through hole 614 is an air inlet hole. When an airflow enters the interior of the first chamber 611 along the first through hole 613, the airflow pushes the piston 64, and drives the first piston rod 63 to move toward the second chamber 612, and the first through hole 614 exhausts. Conversely, if the airflow enters the interior of the second chamber 612 along the second through hole 614, the airflow pushes the piston 64 and drives the first piston rod 63 to move toward the first chamber 611, and the first through hole 613 exhausts.

In this specific implementation, the antenna mount further includes an external cylinder control module, and the external cylinder control module is configured to control the direction and the volume of airflow entering the first through hole 613 or the second through hole 614, so that the first piston rod 63 of the non-metallic cylinder 06 drives the rotary sleeve to rotate in the range of 0-90°, and then drives the antenna to rotate in the range of 0-90°.

In this specific implementation, a first annular sealing element 641 is provided at a portion where the first piston 64 is coupled with the first cylinder body 61, and a second annular sealing element 615 is provided at a portion where the first cylinder body 61 is coupled with the first piston rod 63; a third annular sealing element 621 is provided at a portion where the end cover 62 is coupled with the first piston rod 63.

The first annular sealing element 641, the second annular sealing element 615, and the third annular sealing element 621 are all non-metallic seal rings, such as rubber soft rings. The annular sealing elements can prevent an air leakage at the portion where the first piston is coupled with the first cylinder body, the portion where the first cylinder body is coupled with the first piston rod, and the portion where the end cover is coupled with the first piston rod, that is, playing the role of sealing.

Each components of the cylinder 06 are all non-metallic materials, commonly, such as polyoxymethylene and polytetrafluoroethylene, which prevent interference to electromagnetic compatibility testing.

In this specific implementation, a mounting screw hole (not shown in FIG. 5) is provided on one side of the second adapting piece 04 with the fourth mounting hole 45, and a matching mounting screw hole is provided on the end cover 62 of the non-metallic cylinder 06. The end cover 62 of the non-metallic cylinder 06 is screwed joint to the side of the second adapting piece 04 with the second mounting hole 45 by a screw.

A rotation angle adjustable antenna of the present disclosure makes the rotation of the antenna 03 and the advancement and ejection of the piston rod 14 linked by the action of the cylinder; thus, the antenna can rotate in the range of 0-90°.

Figure 8:
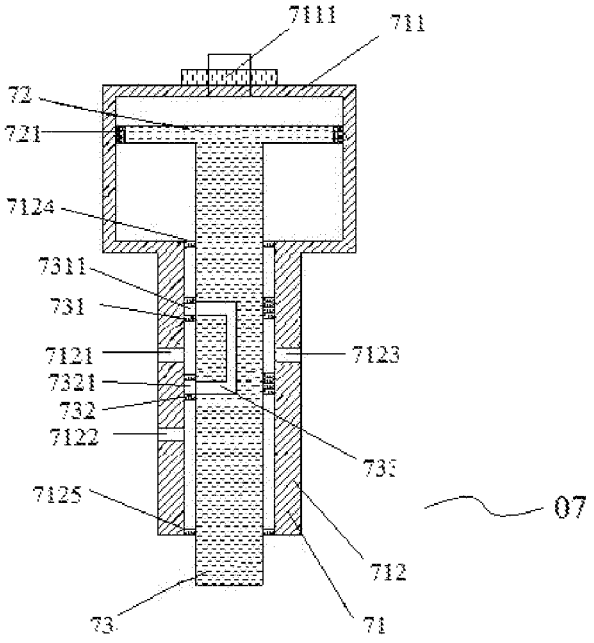
FIG. 8 is a sectional view illustrating a first non-metallic position sensor 07 of state 1 according to an embodiment of the present disclosure.
Figure 9:
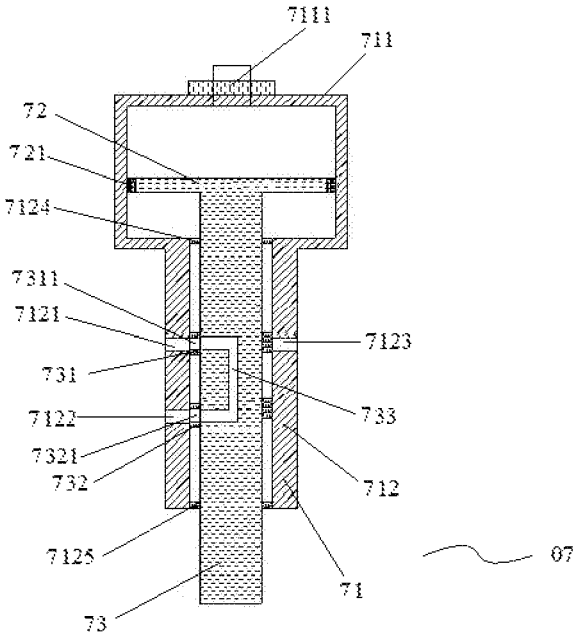
FIG. 9 is a sectional view illustrating the first non-metallic position sensor 07 of state 2 according to an embodiment of the present disclosure.

According to a twelfth implementation of the present disclosure, the first non-metallic position sensor 07 sends a first air pressure signal to the outside when the antenna 05 is raised relative to the second adapting piece 04 in the third implementation of the present disclosure, a structure of the first non-metallic position sensor 07 provided by an embodiment of the present disclosure is shown in FIG. 8 and FIG. 9 (FIG. 8 is a sectional view illustrating a first non-metallic position sensor 07 of state 1 according to an embodiment of the present disclosure; FIG. 9 is a sectional view illustrating the first non-metallic position sensor 07 of state 2 according to an embodiment of the present disclosure), the first non-metallic position sensor 07 further includes:

a second cylinder body 71, a second piston 72 placed in the second cylinder body 71, and a second piston rod 73 whose one end is fixedly connected with the second piston 72; the second cylinder body 71 includes a second cylinder body upper chamber 711 and a second cylinder body lower chamber 712; a side wall of the second cylinder body lower chamber 712 is provided with a first radial air hole 7121, a second radial air hole 7122 arranged on the lower end of the first radial air hole 7121, and a third radial air hole 7123 arranged axially symmetrically with the first radial air hole 7121;

a portion of the second piston rod 73 combined with the inner wall of the second cylinder body lower chamber 712 is provided with a first seal ring 731 and a second seal ring 732 in sequence from top to bottom, and the second piston rod 73 is provided with an I-shaped breather pipe 733 internally; an axial distance between the first seal ring 731 and the second seal ring 732 is equal to an axial distance between the first radial air hole 7121 and the second radial air hole 7122; the first seal ring 731, the second seal ring 732, and the inner chamber of the second cylinder body lower chamber 712 are sealed and in clearance fit; and the first seal ring 731 is provided with a first radial through-hole 7311, the second seal ring 732 is provided with a second radial through-hole 7321;

the second adapting piece 04 further includes a fifth mounting hole 46 arranged on the outer periphery of the cavity 42 of the second adapting piece 04 and penetrating the upper and lower surfaces of the second adapting piece 04; the second cylinder body 71 of the first non-metallic position sensor 07 is arranged in the fifth mounting hole 46 of the second adapting piece 04, and another end of the second piston rod 73 of the first non-metallic position sensor 07 extends out of the fifth mounting hole 46;

the antenna 05 is configured to detect that an end of a test object and the end of the second piston rod 73 which is in the first non-metallic position sensor 07 and extends out of the fifth mounting hole 46 are connected through a junction plate, and an axial distance between the end of the second piston rod 73 extending out of the fifth mounting hole 46 and the test object is equal to an axial distance between an end of the antenna 05 and the test object;

the antenna 05 drives the second piston rod 73 in the first non-metallic position sensor 07 to rise relative to the second cylinder body 71 when the antenna 05 rises relative to the second adapting piece 04; the first radial air hole 7121 is communicated with the third radial air hole 7123 when the antenna 05 rises to a first position relative to the second adapting piece 04.

Furthermore, one of the first radial air hole 7121 and the third radial air hole 7123 is an air inlet hole, and the other is an air outlet hole; wherein the air inlet hole is connected with an external air inlet device and the air outlet hole is connected with an external gas-electric conversion device.

In this specific implementation, the first non-metallic position sensor 07 (the air outlet hole of the first radial air hole 7121 and the third radial air hole 7123) sends the first air pressure signal to the outside when the first radial air hole 7121 is communicated with the third radial air hole 7123.

It can be understood that, at least one end of the antenna 05 extends out of the third mounting hole 44 as a detection end. During the test, the detection end of the antenna 05 is in contact with the test object and is configured to detect the test object.

In this specific implementation, the end of the second cylinder body upper chamber 711 is further provided with an axial air inlet hole 7111. The airflow enters the second cylinder body 71 through the axial air hole 7111, and pushes the second piston rod 73 to move downward relative to the second cylinder body 71; the first radial air hole 7121, the second radial air hole 7122, the first radial through hole 7311, and the second radial through hole 7321 can communicate with each other through an I-shaped breather pipe 733: when the second piston rod 73 declines to a second position, a pipe mouth of the I-shaped breather pipe 733, the first radial through hole 7311, and the first radial air hole 7121 are communicated with each other, and the other pipe mouth of the I-shaped breather pipe 733, the second radial through hole 7321, and the second radial air hole 7122 are communicated with each other, that is, the first radial air hole 7121 is communicated with the second radial air hole 7122.

Optionally, the airflow of the first external air inlet device entering the second cylinder body 71 through the axial air hole 7111 is controlled by an external control device. The external control device presets an airflow parameter, by which controls the airflow of the second cylinder body 71, which can just push the second piston rod 73 to move downward relative to the second cylinder body 71 and let the first radial air hole 7121 communicated with the second radial air hole 7122.

Optionally, one of the first radial air hole 7121 and the second radial air hole 7122 is an air inlet hole, and the other is an air outlet hole; wherein the air inlet hole is connected with an external air inlet device and the air outlet hole is connected with an external gas-electric conversion device. When the first radial air hole 7121 is communicated with the second radial air hole 7122, the first non-metallic position sensor 07 (the air outlet hole of the first radial air hole 7121 and the second radial air hole 7122) is configured to send a second air pressure signal to the outside, and when the external gas-electric conversion device receives the second air pressure signal, the external gas-electric conversion device converts the second air pressure signal to a second electric signal and send the second electric signal to the external control device; the external control device determines that the second piston rod 73 moves downwards relative to the second cylinder body 71 to conduct the first radial air hole 7121 and the second radial air hole 7122, and controls the first external air inlet device to stop gas supply to the axial air hole 7111.

It can be understood that, the airflow through the axial air hole 7111 into the second cylinder body 71 can reset the second piston rod 73 to the state 2. Since the second piston rod 73 of the first non-metallic position sensor 07 is connected with the antenna 05 via a junction plate, when the second piston rod 73 is reset to the state 2, the antenna 05 achieves a synchronous reset (that is, declining relative to the second adapting piece 04, optionally, the lifting range can be defined according to the size of specific products, such as, declining by 21 mm).

It can be understood that, as shown in FIG. 8 of state 1, the second piston rod 73 moves in the inner cavity of the second cylinder body 71 to make the first radial air hole 7121 communicated with the third radial air hole 7123. As shown in FIG. 9 of state 2, the second piston rod 73 moves in the inner cavity of the second cylinder body 71 to make the first radial air hole 7121 communicated with the second radial air hole 7122 through the breather pipe 733.

In this specific implementation, a portion of the second piston rod 73 combined with the inner wall of the second cylinder body upper chamber 711 is provided with a third seal ring 731, the third seal ring 731 and the inner chamber of the second cylinder body upper chamber 711 are sealed and in clearance fit; the inner wall of the second cylinder body upper chamber 711 is provided with a fourth seal ring 7124 and a fifth seal ring 7125 in sequence from top to bottom; One end (the head end) of the second piston rod 73 is fixedly connected with the second piston 72 through the through hole formed on the fourth seal ring 7124, the second piston rod 73 and the fourth seal ring 7124 are sealed and in clearance fit, and the other end (the tail end) passes through the through hole formed on the fifth seal ring 7125, the second piston rod 73 and the fifth seal ring 7125 are sealed and in clearance fit.

It can be understood that, in this implementation, the fourth seal ring 7124 divides the second cylinder body 71 into the second cylinder body upper chamber 711 and the second cylinder body lower chamber 712.

Specifically, all components of the first non-metallic position sensor 07 used for electromagnetic compatibility testing are made of non-metallic materials. For example, the annular sealing elements can be rubber pistons, which can avoid interference to electromagnetic compatibility testing.

It can be understood that, the terms "up" and "down" in the present disclosure do not represent an absolute space. For example, if the position of the axial air inlet hole 7111 provided on one end of the second cylinder body 71 is marked as "up", and the position of the fifth seal ring 7125 provided on the other end of the second cylinder body 71 is marked as "down", the spatial relationship of the other components of the non-metallic position sensor 07 can be marked based on the above-mentioned standard.

It can be understood that, in state 1 shown in FIG. 8, when the first radial air hole 7121 is communicated with the third radial air hole 7123, one of the first radial air hole 7121 and the third radial air hole 7123 is an air inlet hole, and the other is an air outlet hole; in state 2 shown in FIG. 8, when the first radial air hole 7121 is communicated with the second radial air hole 7122, one of the first radial air hole 7121 and the second radial air hole 7122 is an air inlet hole, and the other is an air outlet hole.

It can be understood that, in state 1 shown in FIG. 8, when the antenna mount is used, the first external air inlet device controls airflow through the axial breather hole 7111 into the second cylinder body 71 and pushes the second piston rod 73 to move downwards relative to the second cylinder body 71; when the second piston rod 73 moves to the position of state 2 in FIG. 9, the first radial air hole 7121 is communicated with the second radial air hole 7122, and compressed air flows through the first radial air hole 7121 and the second radial hole 7122. Optionally, the switchover between state 1 shown in FIG. 8 and state 2 shown in FIG. 9 can be realized by an external control device controlling an air inlet volume of the first external air inlet device. Optionally, the switchover between state 1 and state 2 can be realized by the following signal feedback: when the first radial air hole 7121 is communicated with the second radial air hole 7122, the first radial air hole 7121 or the second radial air hole 7122 sends a second air pressure signal to the outside, and the second air pressure signal triggers a micro-switch of the external gas-electric conversion device, the external gas-electric conversion device converts the second air pressure signal to a second electric signal, which represents that the entire device returns to a state to be measured; when the external control device receives the second electric signal, the external control device controls the first external air inlet device to stop gas supply to the axial air hole 7111.

When the tail end of the second piston rod 73 together with the end of the antenna 05 touch the test object, the connecting arm 02 drives the second adapting piece 04 to continue to move to the test object, because the antenna 05 can perform a specific lifting movement relative to the second adapting piece 04 (optionally, the lifting range can be defined according to the size of specific products, such as, 21 mm), the second piston rod 73 moves upwards relative to the second cylinder body 71, when the second piston rod 73 moves upwards to the position of state 1 (as shown in FIG. 8), the first radial air hole 7121 is communicated with the third radial air hole 7123, compressed air flows through the first radial air hole 7121 and the third radial hole 7123, and ejects a first air pressure outwards, which will triggers the micro-switch of the external gas-electric conversion device, the external gas-electric conversion device converts the first air pressure signal to a first electric signal, which represents that the antenna has effectively touched the test object; when the external control device receives the first electric signal, on the one hand, the external control device can control the working state of the X-axis, Y-axis, and/or Z-axis motors, so as to make the connecting arm no longer move in the direction toward the test object; on the other hand, the external control device can feedback to the technician that a good detection position has been found and the test can be carried out. Optionally, after receiving the first electric signal, the external control device can also store the position coordinates of the antenna currently, including but not limited to one or more position coordinate information like X-axis coordinate, Y-axis coordinate, Z-axis coordinate, antenna rotation angle, antenna horizontal state and antenna vertical state, so as to realize repeated automatic detections of the same test point.

The design of the present disclosure can effectively sense the effective touch of the antenna to the test object, and prevent the antenna from being damaged due to excessive proximity to the test object. More importantly, these features are implemented using non-metallic drive and/or sensing structures that are not only smart and highly automated, but also do not introduce electromagnetic interference into the test environment.

Optionally, the external gas-electric conversion device is connected with y external control device and sends an electrical signal to the external control device. After acquiring the first electric signal, the external control device does not operate the instruction which makes the antenna further approach the test object, thereby preventing the antenna from being damaged due to excessive proximity to the test object.

The antenna mount provided by the present disclosure has a simple working principle, high measurement accuracy, and high reliability; more importantly, it can realize the movement of the antenna in a 5-dimensional space, including: motor-controlled X-axis, Y-axis, and Z-axis movements, 0-90° rotation controlled by pneumatics, and the positional transition of the antenna horizontally or vertically.

Figure 10:
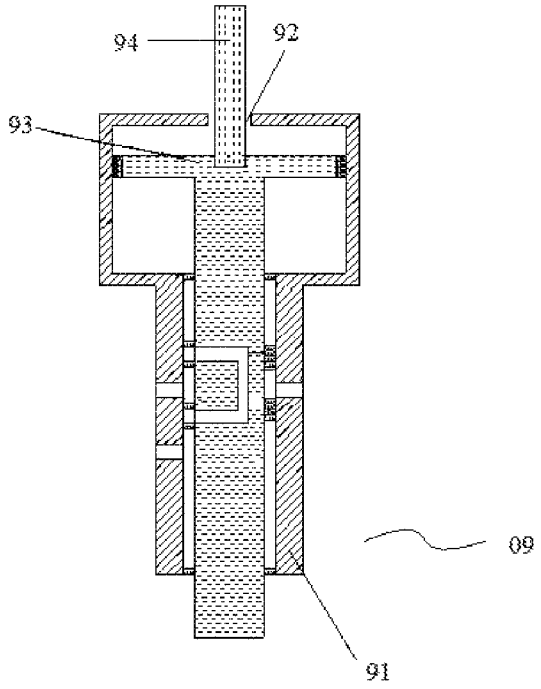
FIG. 10 is a sectional view illustrating a second non-metallic position sensor 09 of state 1 according to an embodiment of the present disclosure.
Figure 11:
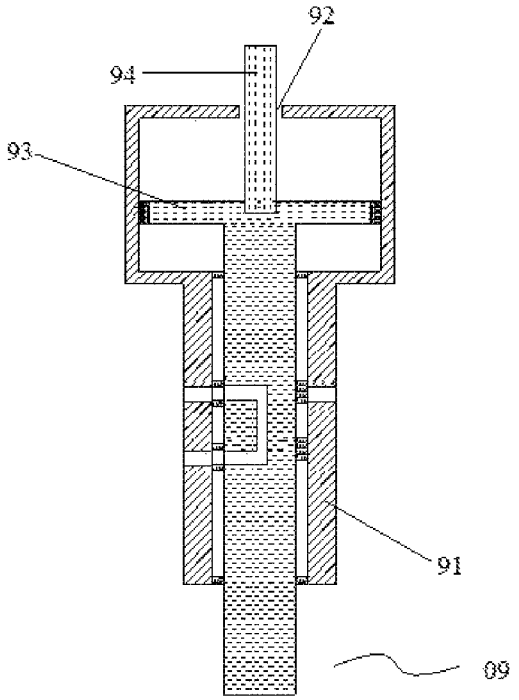
FIG. 11 is a sectional view illustrating the second non-metallic position sensor 09 of state 2 according to an embodiment of the present disclosure.

FIG. 10 is a schematic structural diagram illustrating a second non-metallic position sensor 09 of state 1 according to an embodiment of the present disclosure; FIG. 11 is a schematic structural diagram illustrating the second non-metallic position sensor 09 of state 2 according to an embodiment of the present disclosure.

According to a thirteenth implementation of the present disclosure, as shown in FIG. 9, the antenna mount further includes a second non-metallic position sensor 09, and in the connecting scheme of connecting the first adapting piece 03 and the second adapting piece 04 through a step-type connecting shaft 08 according to the ninth implementation of the present disclosure, the step-type connecting shaft 08 (preferably the third step) is further connected with the second non-metallic position sensor 09, wherein the structure of the second non-metallic position sensor 09 is the same as that of the first non-metallic position sensor 07 provided by the present disclosure except for the following difference: the end of the second cylinder body 71 of the first non-metallic position sensor 07 provided by the present disclosure is provided with the axial air inlet hole 7111. while, the end of the third cylinder body 91 of the second non-metallic position sensor 09 provided by the present disclosure is not provided with an axial air inlet hole but an axial through hole 92 and a connecting rod 94 whose head end is fixed on the third piston 93, and the tail end of the connecting rod 94 passes through the axial through hole 92 and protrudes from of the third cylinder body 91.

Specifically, the connecting rod 94 of the second non-metallic position sensor 09 is connected with the step-type connecting shaft 08 through a transmission connecting part; when the step-type connecting shaft 08 rotates around the axis, the step-type connecting shaft 08 can drive the connecting rod 94 to perform telescopic movement through the transmission connecting part.

It can be understood that, when the second adapting piece 04 is manually rotated to switch the antenna 05 between the vertically placed state and the horizontally placed state, the first adapting piece 03 drives the step-type connecting shaft 08 to rotate, thereby driving the connecting rod of the second non-metallic position sensor 09 to telescopically move, which can reach state 1 (as shown in FIG. 10) or state 2 (as shown in FIG. 11), the telescopic movement causes conduction of different air holes, which forms a third or fourth air pressure signal, and triggers the micro-switch of the external gas-electric conversion device, the external gas-electric conversion device converts the third or fourth air pressure signal into a third or fourth electric signal, so that when the external control device receives the third or fourth electric signal, the external control device can detect or show that the antenna is vertically placed or horizontally placed.

It should be noted that technical solutions obtained by combining two or more implementations of the first to thirteenth implementations of the present disclosure should still be included in the scope of the present application.

It should be noted that, in order to reduce the interference of the antenna mount itself to the test, the connecting arm 02, the first adapting piece 03, the second adapting piece 04, the antenna 05, the non-metallic cylinder 06, the first non-metallic sensor 07, the step-type connecting shaft 08, the second non-metallic sensor 09, and the connecting parts between these components in the implementation of the present disclosure are all made of non-metallic materials.

Embodiment Two a System for Controlling Antenna Position

Figure 12:
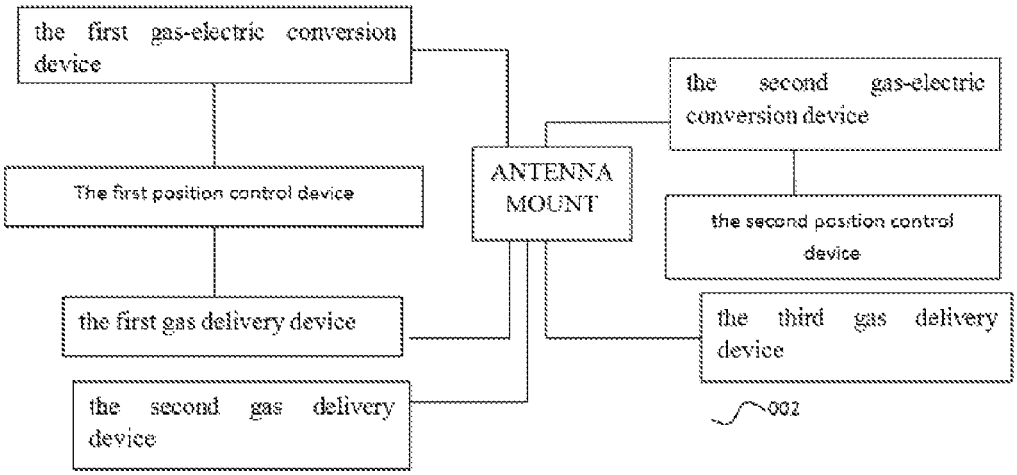
FIG. 12 is a schematic diagram illustrating a system 002 for controlling antenna position according to an embodiment of the present disclosure.

FIG. 12 is a schematic diagram illustrating a system for controlling antenna position according to an embodiment of the present disclosure.

As shown in FIG. 12, the embodiment two of the present disclosure provides a system 002 for controlling antenna position, the system includes an antenna mount 001 provided by embodiments of the present disclosure, the system further includes a first gas-electric conversion device connected with the first non-metallic position sensor 07 of the antenna mount 001, and a first position control device connected with the first gas-electric conversion device;

when the second piston rod 73 of the first non-metallic position sensor 07 in the antenna mount 001 is raised to conduct the first radial air hole 7121 and the second radial air hole 7123, the first non-metallic position sensor 07 sends a first air pressure signal to the first gas-electric conversion device; the first gas-electric conversion device is configured to convert the received first air pressure signal to a first electric signal and send the first electric signal to the first position control device;

the first position control device is configured to determine that the first piston rod of the first non-metallic position sensor 07 and/or the antenna 05 effectively touches a test object when receiving the first electric signal sent by the first gas-electric conversion device.

According to a fourteenth implementation of the present disclosure, the system 002 for controlling antenna position further includes a first gas delivery device connected with the first position control device, and the first position control device is configured to: determine that the first piston rod of the first non-metallic position sensor 07 and/or the antenna 05 effectively touches the test object, and send air supply instruction to a first gas delivery device, when receiving the first electric signal sent by the first gas-electric conversion device; the first gas delivery device is configured to supply gas to a cylinder of the first non-metallic position sensor 07, the airflow enters the second cylinder body 71 through the axial air hole 7111 at the end of the second cylinder body upper chamber 711, and pushes the second piston rod 73 to move downwards relative to the second cylinder body 71.

Furthermore, when the second piston rod 73 declines relative to the second cylinder body 71 to conduct the first radial air hole 7121 and the second radial air hole 7122, the first non-metallic position sensor 07 sends the second air pressure signal to the first gas-electric conversion device; the first gas-electric conversion device is configured to: convert the second air pressure signal received into the second electric signal and send the second electric signal to the first position control device; the first position control device is configured to determine that the second piston rod 73 of the first non-metallic position sensor 07 and/or the antenna 05 is already in the reset state (for example, state 2 in FIG. 8) when the second electric signal sent by the first gas-electric conversion device is received.

According to a fifteenth implementation of the present disclosure, the second gas delivery device provided by the embodiment of the present disclosure is configured to deliver gas to the air inlet hole of the first radial air hole 7121, the second radial air hole 7122, and the third radial air hole 7123. It can be understood that, according to the present disclosure, the air outlet hole of the first radial hole 7121, the second radial hole 7122, and the third radial hole 7123 of the first non-metallic position sensor 07 are configured to output the first or second air pressure (that is, the first or second air pressure signal) to the gas-electric conversion device.

According to a sixteenth implementation of the present disclosure, the system 002 for controlling antenna position further includes a second non-metallic position sensor 09 in the thirteenth implementation of the present disclosure, a second gas-electric conversion device connected with the second non-metallic position sensor 09, and a second position control device connected with the second gas-electric conversion device; wherein, the second gas-electric conversion device is connected with the second non-metallic position sensor 09 in the thirteenth implementation of the present disclosure, when different air holes on the cylinder of the second non-metallic position sensor 09 communicate with each other, the second non-metallic position sensor 09 sends a third or fourth air pressure signal to the second gas-electric conversion device; the second gas-electric conversion device is configured to convert the received third or fourth air pressure signal into a third or fourth electric signal; the second position control device is configured to: when receiving the third or fourth electric signal, determine that the antenna is placed vertically or horizontally.

Optionally, since the second position control device can determine the antenna is placed horizontally or vertically, the second position control device can further be the preset by a control program of the second position control device of the present disclosure. For example, when the second position control device determines that the antenna is in a horizontally placed state, the control program of the second position control device is preset not to output an instruction for controlling the antenna to move in a certain direction, thereby avoiding the antenna to move invalidly.

In this specific implementation, the system 002 for controlling antenna position provided by Embodiment 2 of the present disclosure further includes a third gas delivery device, the third gas delivery device is configured to delivery gas to the air inlet hole of the first radial air hole, the second radial air hole, and the third radial air hole of the second non-metallic position sensor 09. Each radial air hole is not shown in FIG. 10 and FIG. 11, but the position of these radial air holes are corresponding to the first radial air hole 7121, the second radial air hole 7122, and the third radial air hole 7123 in FIG. 8, respectively. It can be understood that, as described in the present disclosure, the air outlet hole of first radial air hole, the second radial air hole, and the third radial air hole of the second non-metallic position sensor 09 is configured to output a third or fourth air pressure (that is, a three or fourth air pressure signal) to the second gas-electric conversion device.

Furthermore, the third gas delivery device delivers gas to the non-metallic cylinder 06, and the first piston rod of the non-metallic cylinder 06 drives the rotary sleeve to rotate in a range of 0-90°, thereby driving the antenna to perform 0-90° rotation.

Optionally, the first position control device and the second position control device are the same computer, and it can be understood that the computer of the present disclosure can also be used to record position coordinates sent by each position sensor of the antenna mount, including but not limited to the X, Y, Z three-dimensional coordinates sent by the X, Y, and Z axis position sensors; when repeatedly detecting the same coordinate point, the computer can send commands to control the X, Y, Z axis motors to move the antenna to the previously recorded X, Y, Z coordinate point.

The above embodiments are merely used for the convenience of describing the present disclosure and are not limited thereto. Without departing from the spirit of the present disclosure, various simple transformations and modifications made by those skilled in the art according to the scope and the specification of the present disclosure should be included in the scope of the present application.

What is claimed is:

1. An antenna mount, comprising: an antenna mount body, a connecting arm connected to the antenna mount body, an adapting piece fixedly connected to the connecting arm, an antenna arranged on the adapting piece, and a non-metallic cylinder arranged on the adapting piece, wherein the non-metallic cylinder can drive the antenna to rotate in a range of 0-90°, wherein the adapting piece comprising a first adapting piece fixedly connected to the connecting arm and a second adapting piece connected to the first adapting piece, the antenna and the non-metallic cylinder being mounted on the second adapting piece; wherein the following structure can realize that, the non-metallic cylinder can drive the antenna to rotate in a range of 0-90°:

the second adapting piece comprising: a hollow cavity, an empty slot arranged inside the cavity, a third mounting hole arranged inside the cavity and penetrating upper and lower surfaces of the adapting piece, and a fourth mounting hole communicated with the empty slot;

the non-metallic cylinder comprising a first cylinder body, an end cover, a first piston rod, and a first piston placed in the first cylinder body; a first end of the first piston rod being fixedly connected with the first piston, a second end of the first piston rod passing through a through hole formed on the end cover and exposing outside the first cylinder body; the first piston rod of the non-metallic cylinder being placed in the empty slot of the second adapting piece after passing through the end cover then passing through the fourth mounting hole of the second adapting piece; the antenna being mounted in the third mounting hole with a rotary sleeve arranged outside, and the first piston rod being connected with the rotary sleeve; wherein the first piston rod can drive the rotary sleeve to rotate in the range of 0-90° when telescopically moving back and forth along the empty slot, and then driving the antenna to rotate in the range of 0-90°.

2. The antenna mount of claim 1, the adapting piece comprising a first adapting piece fixedly connected to the connecting arm and a second adapting piece connected to the first adapting piece, the antenna and the non-metallic cylinder being mounted on the second adapting piece;

wherein the antenna can move up and down relative to the second adapting piece.

3. The antenna mount of claim 2, wherein the second adapting piece comprising a hollow cavity and a third mounting hole arranged inside the cavity and penetrating upper and lower surfaces of the second adapting piece; the antenna being mounted in the third mounting hole with a rotary sleeve arranged outside, at least one end of the antenna extending out of the third mounting hole; wherein, the rotary sleeve comprises an inner sleeve fixedly connected with the antenna and an outer sleeve arranged outside of the inner sleeve; an axial sliding slot being arranged on a surface of the inner sleeve near the outer sleeve, a surface of the outer sleeve near the inner sleeve being provided with a slider which is matched with the sliding slot and can move along the sliding slot.

4. The antenna mount of claim 1, the adapting piece comprising a first adapting piece fixedly connected to the connecting arm and a second adapting piece connected to the first adapting piece, the antenna and the non-metallic cylinder being mounted on the second adapting piece; the antenna mount further comprising a first non-metallic position sensor arranged on the second adapting piece, wherein the antenna can move up and down relative to the second adapting piece, and the first non-metallic position sensor sending a first air pressure signal to the outside when the antenna being raised to a first position relative to the second adapting piece.

5. The antenna mount of claim 4, wherein the first non-metallic position sensor comprising: a second cylinder body, a second piston placed in the second cylinder body, and a second piston rod whose one end is fixedly connected with the second piston; the second cylinder body comprising a second cylinder body upper chamber and a second cylinder body lower chamber; a side wall of the second cylinder body lower chamber being provided with a first radial air hole, a second radial air hole arranged on the lower end of the first radial air hole, and a third radial air hole arranged axially symmetrically with the first radial air hole;

a portion of the second piston rod combined with the inner wall of the second cylinder body lower chamber being provided with a first seal ring and a second seal ring in sequence from top to bottom, and the second piston rod being provided with a breather pipe internally; an axial distance between the first seal ring and the second seal ring being equal to an axial distance between the first radial air hole and the second radial air hole; the first seal ring, the second seal ring, and the inner chamber of the second cylinder body lower chamber being sealed and in clearance fit; and the first seal ring being provided with a first radial through-hole, the second seal ring being provided with a second radial through-hole;

the second adapting piece further comprising a fifth mounting hole arranged on the outer periphery of the cavity of the second adapting piece and penetrating the upper and lower surfaces of the second adapting piece; the second cylinder body of the first non-metallic position sensor being arranged in the fifth mounting hole of the second adapting piece, and another end of the second piston rod of the first non-metallic position sensor extending out of the fifth mounting hole;

the antenna being configured to detect that an end of a test object and the end of the second piston rod which is in the first non-metallic position sensor and extends out of the fifth mounting hole are connected through a junction plate, and an axial distance between the end of the second piston rod extending out of the fifth mounting hole and the test object being equal to an axial distance between an end of the antenna and the test object;

the antenna driving the second piston rod in the first non-metallic position sensor to rise relative to the second cylinder body when the antenna rises relative to the second adapting piece; the first radial air hole being communicated with the third radial air hole when the antenna rises to a first position relative to the second adapting piece; the first non-metallic position sensor sending the first air pressure signal to the outside when the first radial air hole is communicated with the third radial air hole.

6. The antenna mount of claim 5, wherein a pipe mouth of the breather pipe, the first radial through hole, and the first radial air hole are communicated with each other, and another pipe mouth of the breather pipe, the second radial through hole, and the second radial air hole are communicated with each other, when the second piston rod of the first non-metallic position sensor moves to a second position.

7. The antenna mount of claim 1, the antenna mount body further comprising at least one of an X-axis displacement adjustment mechanism, a Y-axis displacement adjustment mechanism, and a Z-axis displacement adjustment mechanism; and the X-axis displacement adjustment mechanism being configured to drive the connecting arm to move along the X axis, the Y-axis displacement adjustment mechanism being configured to drive the connecting arm to move along the Y axis, and the Z-axis displacement adjustment mechanism being configured to drive the connecting arm to move along the Z axis.

8. The antenna mount of claim 1, the adapting piece comprising a first adapting piece fixedly connected to the connecting arm and a second adapting piece connected to the first adapting piece; a side wall of the first adapting piece being provided with a first mounting hole, an end of a step-type connecting shaft being fixedly connected with the second adapting piece, another end of the step-type connecting shaft being arranged in the first mounting hole of the first adapting piece, wherein the second adapting piece can drive the step-type connecting shaft to rotate around the axis of the step-type connecting shaft.

9. The antenna mount of claim 8, the first adapting piece further comprising a first positioning hole, the second adapting piece further comprising a horizontal positioning hole and a vertical positioning hole, and the first positioning hole of the first adapting piece being detachably connected with the horizontal positioning hole or the vertical positioning hole of the second adapting piece through a bolt; wherein the second adapting piece can drive the step-type connecting shaft to make 0° or 90° rotation around the axis of the step-type connecting shaft when a connecting type of the first adapting piece and the second adapting piece is switched between the horizontal positioning hole and the vertical positioning hole.

10. The antenna mount of claim 8, the antenna mount further comprising a second non-metallic position sensor with a connecting rod which can telescopically move, the connecting rod of the second non-metallic position sensor being connected with the step-type connecting shaft through a transmission adapting piece; and the step-type connecting shaft driving the connecting rod to move telescopically by the transmission adapting piece when the step-type connecting shaft makes 0° or 90° rotation around the axis.

11. A system for controlling antenna position, comprising an antenna mount of claim 4, the system further comprising a first gas-electric conversion device connected with the first non-metallic position sensor of the antenna mount, a first position control device connected with the first gas-electric conversion device; the first non-metallic position sensor of the antenna mount being configured to send a first air pressure signal to the first gas-electric conversion device, the first gas-electric conversion device being configured to convert the received first air pressure signal to a first electric signal and send the first electric signal to the first position control device; and the first position control device being configured to determine that the first non-metallic position sensor and/or the antenna effectively touches a test object when receiving a first electric signal sent by the first gas-electric conversion device.

12. The system for controlling antenna position of claim 11, the system for controlling antenna position further comprising a first gas delivery device connected with the first position control device, and an end of the second cylinder body upper chamber being provided with an axial air hole; wherein the first gas delivery device is configured to supply gas to a second cylinder body upper chamber.

13. The system for controlling antenna position of claim 11, wherein the first non-metallic position sensor is configured to send a second air pressure signal to the first gas-electric conversion device, and the first gas-electric conversion device being configured to: convert the received second air pressure signal to a second electric signal and send the second electric signal to the first position control device; and the first position control device being configured to: determine that the first non-metallic position sensor completes reset, and determine that the antenna can enter a test state, when receiving the second electric signal sent by the first gas-electric conversion device.

14. A system for controlling antenna position, comprising an antenna mount of claim 8, the system further comprising a second non-metallic position sensor, a second gas-electric conversion device connected with the second non-metallic position sensor, and a second position control device connected with the second gas-electric conversion device; the second non-metallic position sensor being configured to send a third air pressure signal or a fourth air pressure signal to the second gas-electric conversion device; the second gas-electric conversion device being configured to convert the received third air pressure signal or the fourth air pressure signal to a third electric signal or a fourth electric signal and send the third electric signal or the fourth electric signal to the second position control device; the second position control device being configured to determine that the antenna is placed vertically or horizontally when receiving the third electric signal or the fourth electric signal.

* * * * *